United States Patent [19]

Nino

[11] Patent Number: 4,862,329

[45] Date of Patent: Aug. 29, 1989

[54] VEHICULAR HEADLAMP

[75] Inventor: Naohi Nino, Shizuoka, Japan

[73] Assignee: Koito Seisakusho Co., Ltd., Tokyo, Japan

[21] Appl. No.: 321,130

[22] Filed: Mar. 9, 1989

[30] Foreign Application Priority Data

Mar. 11, 1988 [JP] Japan ..... 63-57471

[51] Int. Cl.[4] ..... F21M 3/14

[52] U.S. Cl. ..... 362/61; 362/214; 362/346; 362/351

[58] Field of Search ..... 362/61, 80, 83, 211, 362/214, 297, 346, 308, 351

[56] References Cited

U.S. PATENT DOCUMENTS

| | | | |
|---|---|---|---|
| 4,100,594 | 7/1978 | Gould | 362/308 |
| 4,222,027 | 9/1980 | Mikkers | 362/351 |
| 4,511,955 | 4/1985 | Ernst et al. | 362/347 |
| 4,686,610 | 8/1987 | Cibie et al. | 362/61 |
| 4,772,987 | 9/1988 | Kretschmer et al. | 362/61 |
| 4,800,467 | 1/1989 | Lindae et al. | 362/61 |

*Primary Examiner*—Ira S. Lazarus
*Assistant Examiner*—Richard R. Cole
*Attorney, Agent, or Firm*—Sughrue, Mion, Zinn, Macpeak & Seas

[57] ABSTRACT

Herein disclosed is a vehicular headlamp which comprises a concave light reflector having a focus and a light ray converging point, the converging point being positioned in front of the focus with respect to the reflector; a first light source located on the focus; a second light source located behind the focus; a cover member covering front and lower portions of the first light source; a first shade member positioned in the vicinity of the converging point of the light reflector, the first shade member having an upper edge positioned near an optical axis of the light reflector; a second shade member located in the vicinity of a subconverging point at which light rays produced by the second light source and reflected by the light reflector are converged; and a converging lens arranged in front of the first shade member in such a manner that a focus of the lens is positioned on the upper edge of the first shade member. The first and second shade members are respectively formed with mutually facing first and second light reflecting surfaces. The first and second light reflecting surfaces are so arranged and constructed that the light rays from the light reflector are reflected by the second and first reflecting surfaces in this order and directed toward the converging lens.

10 Claims, 5 Drawing Sheets

VEHICULAR HEADLAMP

BACKGROUND OF THE INVENTION

1. Field of the Invention

The present invention relates in general to vehicular headlamps, and more particularly to vehicular headlamps of a so-called "projector type" which comprises a light source for producing light, a concave reflector for reflecting the light forward, a shade member located in front of the concave reflector for partially shading and thus contouring the reflected light, and a converging lens located in front of the shade member for projecting the contoured light beam forward. More specifically, the present invention is concerned with a projector type vehicular headlamp which has two light sources installed therein.

2. Description of the Prior Art

In order to clarify the task of the present invention, one conventional projector type headlamp will be described with reference to FIGS. 4 and 5 of the accompanying drawings.

As is schematically illustrated in FIG. 4, the headlamp "a" comprises a concave light reflector "b" which has an ellipsoidal light reflecting surface formed on an inside face thereof. A light source "c", viz., an electric filament, is placed on a first focus "$F_1$" of the concave light reflector "b". Thus, light rays emitted from the light source "c" are reflected forward by the reflector "b" and converged at a second focus "$F_2$" of the reflector "b". Because the light source "c" has certain dimensions, the bundle of the light rays converged at the second focus "$F_2$" has a certain sectional area.

Designated by reference "e" is a shade member which is positioned in the vicinity of the second focus "$F_2$" having its upper edge "d" contact with an optical axis "x—x" of the concave light reflector "b".

A converging lens "f" is arranged in front of the shade member "e" in such a manner that a focus "$F_c$" thereof is placed on the upper edge "d" of the shade member "e".

When the light source "c" is energized and thus produces light rays, the light rays directed rearward are reflected forward by the light reflector "b" and converged at the second focus "$F_2$" of the reflector "b". Due to presence of the upper edge "d" of the shade member "e" near the second focus "$F_2$", part of the reflected light rays from the reflector "b" is shaded. Thus, the light beam projected forward from the lens "f" has such a contoured cross-sectional pattern "h" as shown in FIG. 5. That is, the projected beam from the lens "f" has an inverted image of the upper edge "d" of the shade member "e", which thus provides a so-called "low beam". It is to be noted that in FIG. 5, the lines denoted by "H—H" and "V—V" are respective horizontal and vertical lines extending perpendicularly to the optical axis "x—x".

In order to provide the headlamp of this type with an additional function of producing a "high beam", an auxiliary light source "i" is necessary, which is to be arranged behind the main light source "c", as is shown by a broken line in FIG. 4.

However, hitherto, the arrangement of the two light sources in the projector type headlamps has been given little thought. That is, the arrangement has been simply made without deeply considering the measure for carrying out the effective usage of the light rays produced by the auxiliary light source "i". Thus, the headlamp of this type is liable to produce a high beam pattern which lacks a brightness. In fact, due to the inherent arrangement, the high beam pattern projected from the lens "f" is largely spread thereby reducing the luminous flux thereof.

SUMMARY OF THE INVENTION

It is therefore an object of the present invention to provide a projector type vehicular headlamp having two light sources, which is free of the above-mentioned drawback.

According to the present invention, there is provided a projector type vehicular headlamp having two light sources, which further has an auxiliary light reflector for effectively using the light rays produced by an auxiliary light source.

According to the present invention, there is provided a vehicular headlamp which comprises a concave light reflector having a focus and a light ray converging point, the converging point being positioned in front of the focus with respect to the reflector; a first light source located on the focus; a second light source located behind the focus; a cover member covering front and lower portions of the first light source; a first shade member positioned in the vicinity of the converging point of the light reflector, the first shade member having an upper edge positioned near an optical axis of the light reflector; a second shade member located in the vicinity of a sub-converging point at which light rays produced by the second light source and reflected by the light reflector are converged; a converging lens arranged in front of the first shade member in such a manner that a focus of the lens is positioned on the upper edge of the first shade member; and first and second light reflecting surfaces respectively defined by the first and second shade members, the first and second light reflecting surfaces being so arranged and constructed that the light rays from the light reflector are reflected by the second and first reflecting surfaces in this order and directed toward the converging lens.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
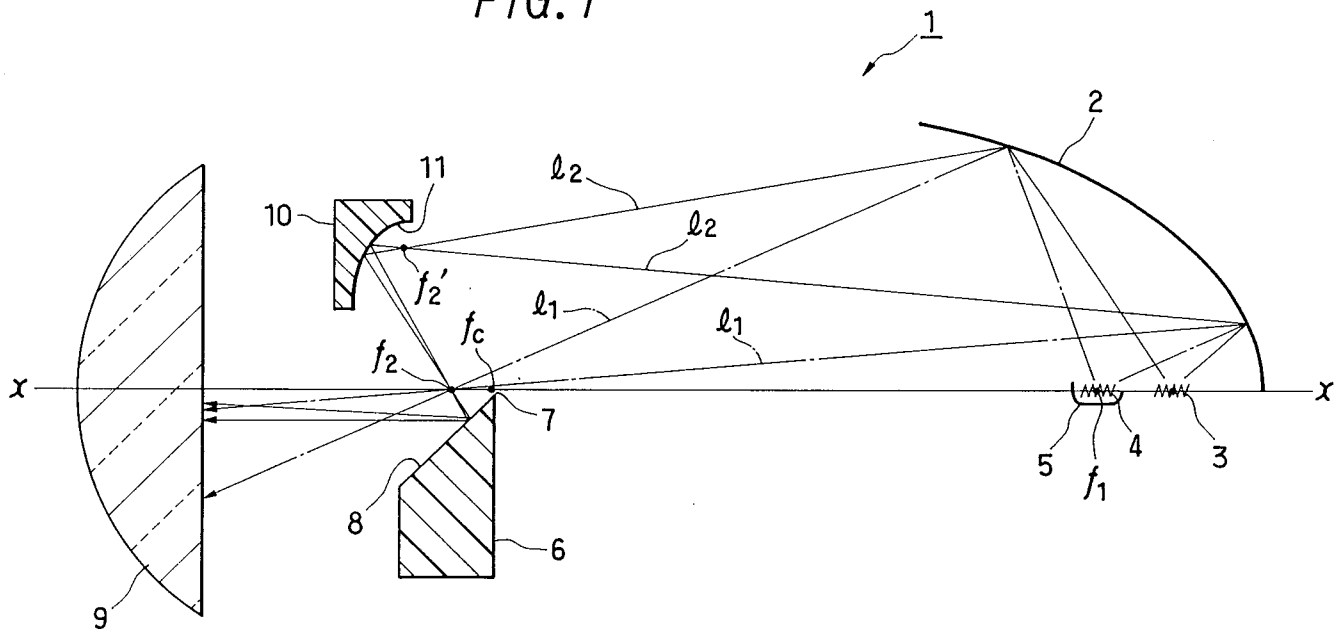
FIG. 1 is a schematically illustrated vertically sectional view of a vehicular headlamp which is a first embodiment of the present invention.

Referring to FIG. 1, there is schematically shown a projector type headlamp of a first embodiment of the present invention.

Designated by numeral 2 is a concave light reflector which has an upper half of an ellipsoidal light reflecting surface formed on an inside face thereof. That is, the light reflecting surface constitutes a part of the entire surface of ellipsoid of revolution with respect to the major axis of the ellipsoid. Designated by reference "x—x" is an axis about which the ellipsoid is symmetrically formed, and which serves as an optical axis of the headlamp.

Designated by numerals 3 and 4 are light sources, viz., filaments, for producing light when electrically energized. As will be understood as the description proceeds, the filament 3 serves as the light source for producing a high beam, while, the filament 4 for a low beam. The filament 3 is located behind a first focus "$f_1$" of the reflector 2 and extends in and along the optical axis "x—x", while, the other filament 4 is located on the first focus "$f_1$" and extends in and along the axis "x—x".

Accordingly, light rays "$l_1$" emitted from the filament 4 are reflected forward by the reflector 2 and converged at a second focus "$f_2$" of the reflector 2. While, light rays "$l_2$" from the other filament 3 are reflected forward by the reflector 2 and converged at a converging point "$f_{2'}$" which is positioned above and in front of the second focus "$f_2$".

Designated by numeral 5 is a filament cover which covers front and lower portions of the filament 4.

Designated by numeral 6 is a first shade member which has a tapered upper portion terminating with an upper edge 7 which is positioned in the vicinity of both the second focus "$f_2$" and the optical axis "x—x". The tapered upper portion is formed with a flat light reflecting surface 8 which faces forwardly upwardly.

A converging lens 9 is arranged in front of the first shade member 6 in such a manner that a focus "$f_c$" thereof is located on the upper edge 7 of the first shade member 6.

Designated by numeral 10 is a second shade member which is located in front of the converging point "$f_{2'}$" of the light rays "$l_2$" from the filament 3 thereby to block a forward travelling of the light rays "$l_2$".

The second shade member 10 has at its rear part a concave light reflecting surface 11. The surface 11 constitutes a part of an ellipsoidal surface which has its first and second focuses at the above-mentioned converging point "$f_{2'}$" and second focus "$f_2$" of the light reflector 2.

Accordingly, the light rays "$l_2$" converged at the converging point "$f_{2'}$" are thereafter reflected rearward by the concave light reflecting surface 11 of the second shade member 10 and converged at the second focus "$f_2$" of the reflector 2. The light rays coming to the second focus "$f_2$" are then reflected forward by the flat light reflecting surface 8 of the first shade member 6 and then projected forward from the lens 9.

It is to be noted that since substantially all light rays produced by the filament 3 are forced to pass through and project forward from the converging lens 9 with a relatively small angle of projection, the high beam produced by the headlamp has a highly illuminated pattern.

Figure 2:
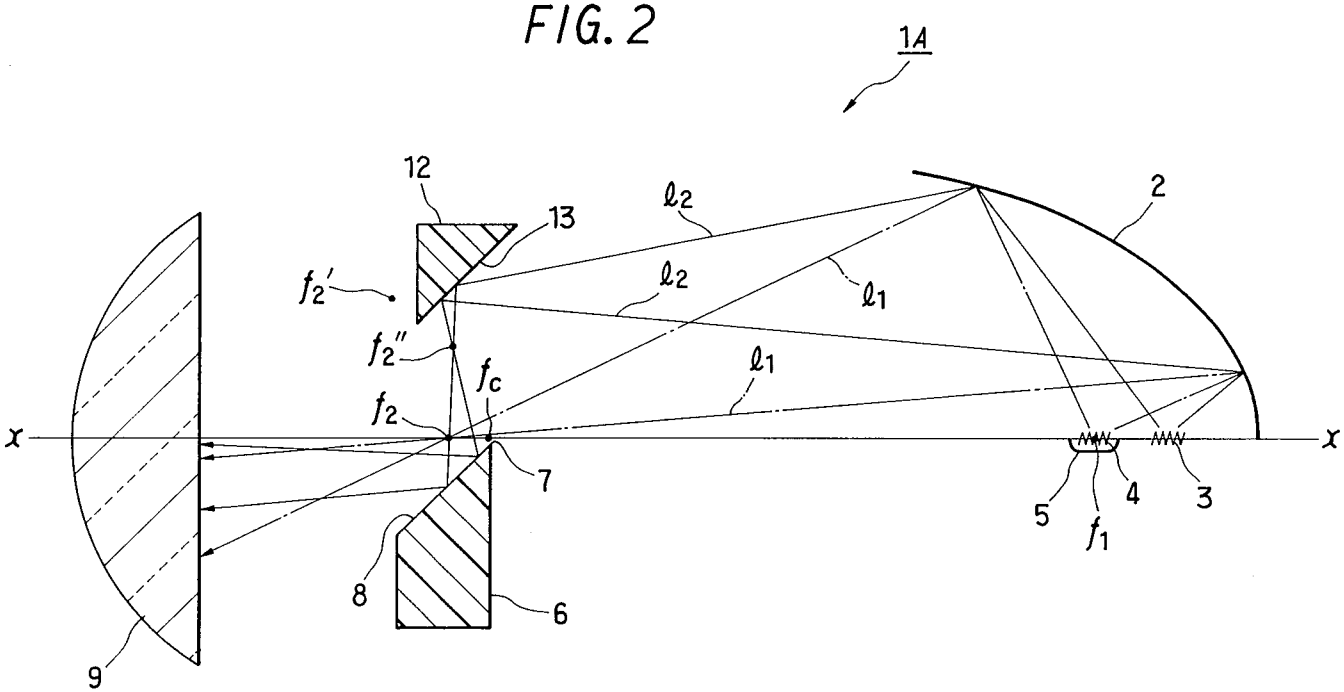
FIG. 2 is a view similar to FIG. 1, but showing a second embodiment of the present invention.

Referring to FIG. 2, there is shown a second embodiment of the present invention.

Since the second embodiment is substantially the same as the above-mentioned first embodiment except a small part, the following explanation on the second embodiment will be directed to only such part. Parts identical to those of the first embodiment are denoted by the same numerals.

As is seen from FIG. 2, a second shade member 12 employed in this second embodiment is located behind the converging point "$f_{2'}$" of the light rays "$l_2$" from the filament 3.

The second shade member 12 has at its rear part a flat light reflecting surface 13 which is so inclined as to converge the light rays "$l_2$" from the reflector 2 at a converging point "$f_{2''}$" between the first and second shade members 6 and 12.

Accordingly, the light rays "$l_2$" converged at the converging point "$f_{2''}$" are then reflected forward by the flat light reflecting surface 8 of the first shade member 6 and then projected forward from the lens 9.

Thus, the light rays "$l_2$" from the filament 3 is effectively used for providing the high beam with a highly illuminated pattern.

Figure 3:
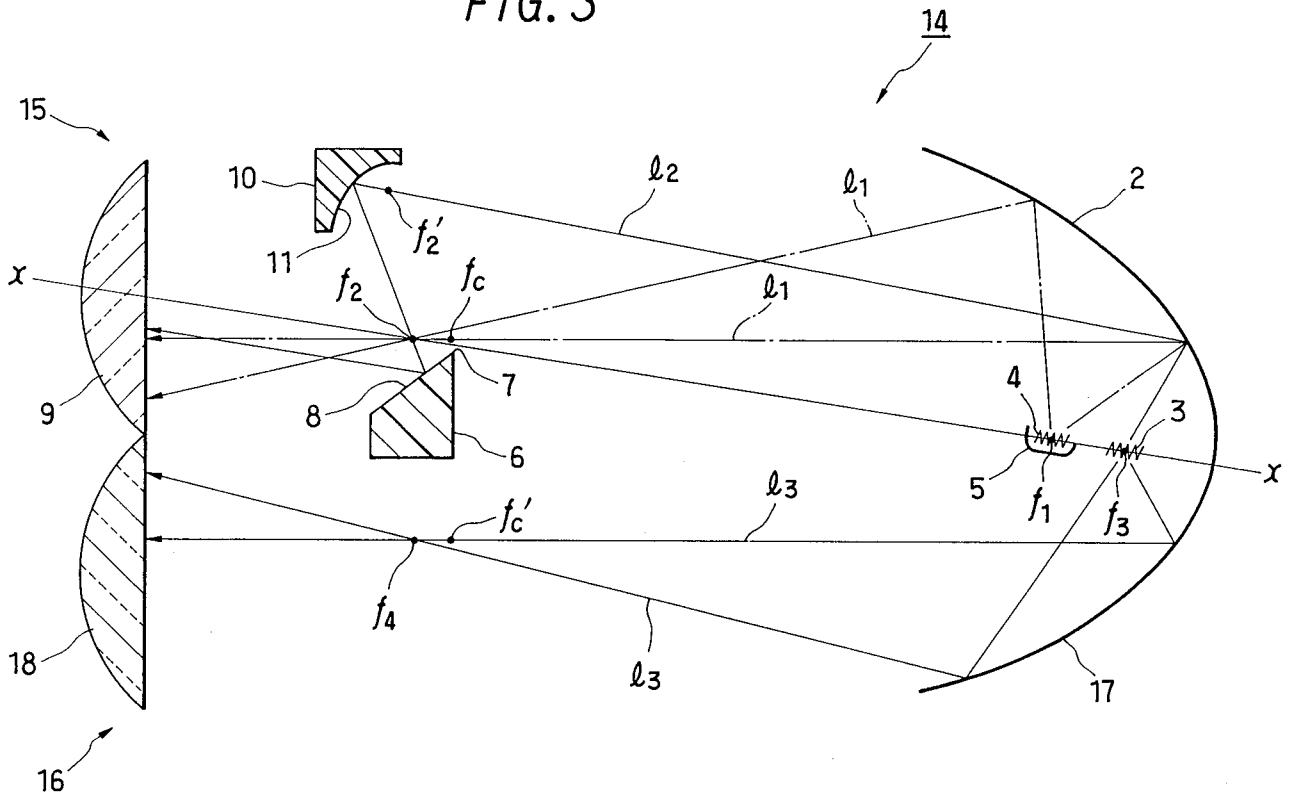
FIG. 3 is a view similar to FIG. 1, but showing a third embodiment of the present invention.
Figure 4:
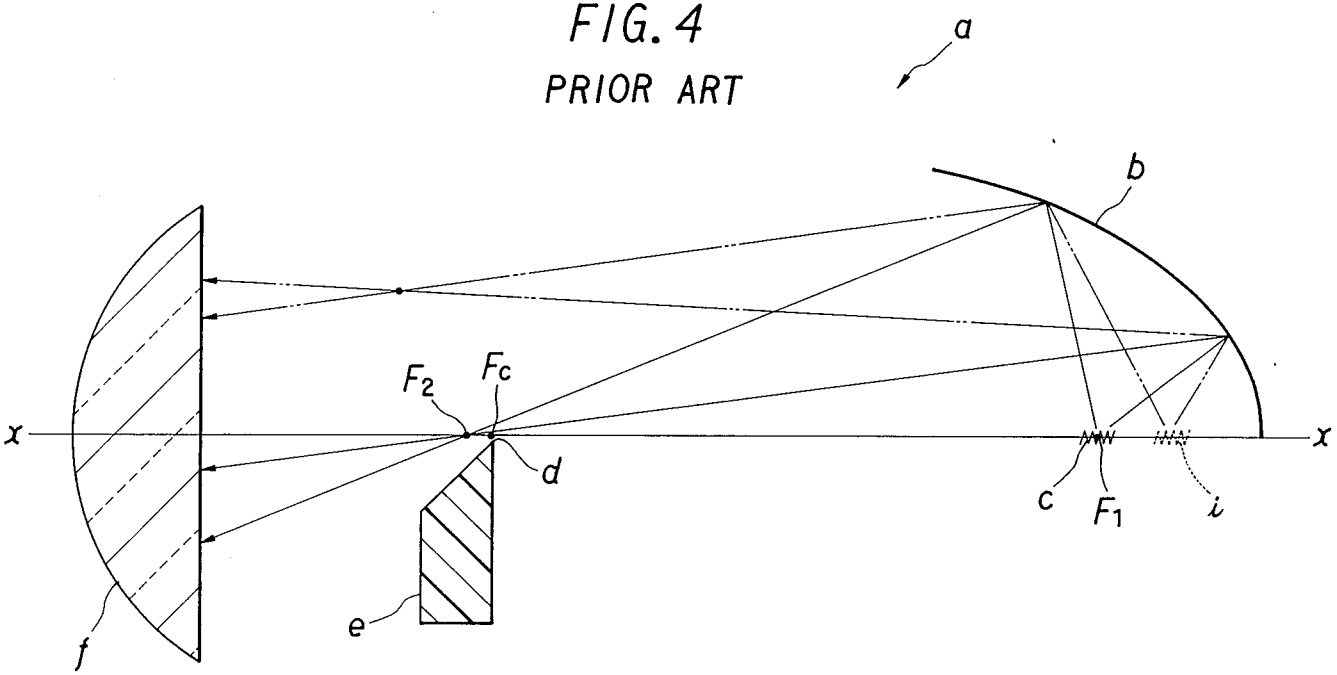
FIG. 4 PRIOR ART
FIG. 4 is a schematically illustrated vertically sectional view of a conventional projector type vehicular headlamp.
Figure 5:
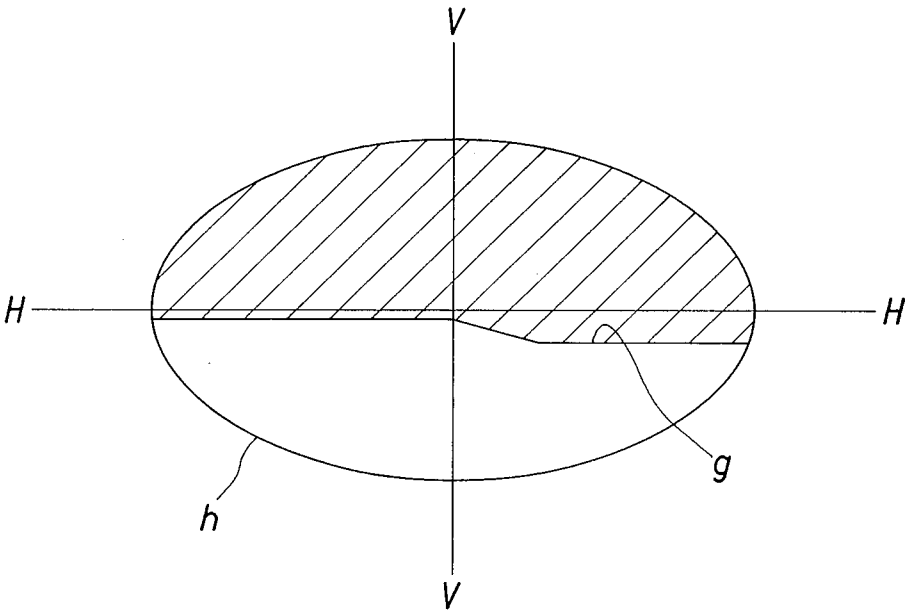
FIG. 5 PRIOR ART
FIG. 5 is a view of a contoured cross-sectional pattern of a light beam projected from the conventional headlamp of FIG. 4.

Referring to FIG. 3, there is shown a third embodiment of the present invention, which is generally designated by numeral 14.

As is seen from the drawing, the third embodiment comprises generally two systems, that is, an upper optical system 15 and a lower optical system 16 which are combined. The upper optical system 15 is similar to the above-mentioned first embodiment of FIG. 1.

Designated by numeral 17 is a concave light reflector which has a lower half of the above-mentioned ellipsoidal light reflecting surface possessed by the reflector 2. That is, the upper and lower light reflectors 2 and 17 are combined to constitute a dome-like light reflector. As is seen from the drawing, a first focus "$f_3$" of the lower reflector 17 is located behind the first focus "$f_1$" of the upper reflector 2. A filament 3 for producing a high beam is arranged on the focus "$f_3$". Designated by reference "$f_4$" is a light ray converging point provided by the lower reflector 17.

Designated by numeral 18 is a converging lens which is arranged in such a manner that a focus "$f_{c'}$" thereof is located in the vicinity of the converging point "$f_4$".

Thus, the light rays "$l_3$" emitted from the filament and reflected by the lower reflector 17 are converged at the point "$f_4$" and projected forward from the lower lens 18. While, the other light rays "$l_2$" reflected by the upper reflector 2 are reflected by the light reflecting surface 11 of the second shade member 10 and the light reflecting surface 8 of the first shade member 6 in this order and then projected forward from the upper lens 9.

Accordingly, the light rays from the filament 3 are effectively used for providing the high beam with a highly illuminated pattern. More specifically, the light produced by the filament 3 is used by both the upper and lower optical systems 15 and 16 for producing the high beam thereby improving the availability of the luminous flux of the beam.

Although the above description is directed to the embodiments in which ellipsoidal light reflectors 2 and 17 are used, the reflector used in the present invention is not limited to such ellipsoidal type. That is, various types of reflectors are usable in the invention so long as they have at least one focus and a converging point or area (which may have a linear shape, circular shape, oval shape or the like) at which light rays emitted from a light source on the focus are converged.

What is claimed is:

1. A vehicular headlamp comprising:

a concave light reflector having a focus and a light ray converging point, said converging point being positioned in front of said focus with respect to the reflector;

a first light source located on said focus;

a second light source located behind said focus;

a cover member covering front and lower portions of said first light source;

a first shade member positioned in the vicinity of said converging point of the light reflector, said first shade member having an upper edge positioned near an optical axis of said light reflector;

a second shade member located in the vicinity of a sub-converging point at which light rays produced by said second light source and reflected by said light reflector are converged;

a converging lens arranged in front of said first shade member in such a manner that a focus of the lens is positioned on said upper edge of said first shade member; and first and second light reflecting surfaces respectively defined by said first and second shade members, said first and second light reflecting surfaces being so arranged and constructed that said light rays from said light reflector are reflected by said second and first reflecting surfaces in this order and directed toward said converging lens.

2. A vehicular headlamp as claimed in claim 1, in which said first reflecting surface is a flat light reflecting surface.

3. A vehicular headlamp as claimed in claim 2, in which said second light reflecting surface is an ellipsoidal light reflecting surface.

4. A vehicular headlamp as claimed in claim 2, in which said second light reflecting surface is a flat light reflecting surface.

5. A vehicular headlamp as claimed in claim 2, in which said light reflector is of an ellipsoidal light reflector having first and second focuses which correspond to said focus and said light ray converging point.

6. A vehicular headlamp as claimed in claim 3, in which said sub-converging point is provided by the light rays which are going to be reflected by said second light reflecting surface of said second shade member.

7. A vehicular headlamp as claimed in claim 4, in which said sub-converging point is provided by the light rays which have been reflected by said second light reflecting surface of said second shade member.

8. A vehicular headlamp as claimed in claim 3, further comprising:

an auxiliary concave light reflector which is united with said concave light reflector to constitute a dome-shaped ellipsoidal light reflector, said auxiliary concave light reflector reflecting forward the light rays emitted by said second light source; and an auxiliary converging lens located in front of said auxiliary concave light reflector to pass therethrough said light rays from said auxiliary light reflector.

9. A vehicular headlamp as claimed in claim 8, in which said auxiliary converging lens is located just below said converging lens.

10. A vehicular headlamp as claimed in claim 1, in which each of said first and second light sources is an electric filament which extends in and along the optical axis of said light reflector.

* * * * *